US008567905B2

(12) United States Patent
Ogasawara

(10) Patent No.: US 8,567,905 B2
(45) Date of Patent: Oct. 29, 2013

(54) INKJET RECORDING APPARATUS

(75) Inventor: Seiji Ogasawara, Machida (JP)

(73) Assignee: Canon Kabushiki Kaisha, Tokyo (JP)

( * ) Notice: Subject to any disclaimer, the term of this patent is extended or adjusted under 35 U.S.C. 154(b) by 13 days.

(21) Appl. No.: 13/216,407

(22) Filed: Aug. 24, 2011

(65) Prior Publication Data

US 2012/0050406 A1 Mar. 1, 2012

(30) Foreign Application Priority Data

Aug. 27, 2010 (JP) ..... 2010-191202

(51) Int. Cl.
*B41J 23/00* (2006.01)

(52) U.S. Cl.
USPC ..... 347/37; 347/14; 347/16; 347/104

(58) Field of Classification Search
USPC ..... 347/8, 16, 37, 40, 42, 43, 49, 67, 103, 347/104, 14, 19, 57
See application file for complete search history.

(56) References Cited

U.S. PATENT DOCUMENTS 6,435,641 B1 * 8/2002 Tung et al. ..... 347/16
6,789,876 B2 * 9/2004 Barclay et al. ..... 347/37
6,827,436 B2 * 12/2004 Nitta et al. ..... 347/108

FOREIGN PATENT DOCUMENTS

JP 2994392 A 4/1990
JP 2003-39758 A 2/2003

* cited by examiner

*Primary Examiner* — Thinh Nguyen
(74) *Attorney, Agent, or Firm* — Canon USA Inc. IP Division

(57) ABSTRACT

An inkjet recording apparatus includes an upstream conveying unit that includes a conveying roller and a pinch roller that is in contact with the conveying roller at a position that is displaced downstream of the conveying roller in a conveying direction of a sheet; a recording head that is disposed downstream of the upstream conveying unit and that discharges liquid; a carriage that supports the recording head and scans in a direction that intersects the conveying direction; a platen that supports the sheet at a position facing the recording head; a downstream conveying unit disposed downstream of the carriage and that conveys the sheet; and a control unit that moves the carriage so that a liquid discharge port surface of the recording head is positioned outside a side edge of the sheet when a trailing end of the sheet passes a nip between the conveying roller and the pinch roller.

22 Claims, 9 Drawing Sheets

INKJET RECORDING APPARATUS

BACKGROUND OF THE INVENTION

1. Field of the Invention

The present invention relates to prevention of smudging of ink on a recording sheet in a recording apparatus, such as an inkjet recording apparatus.

2. Description of the Related Art

Technologies for inkjet recording apparatuses have been proposed that prevent smudging of ink on a surface of a recording sheet due to contact between the recording sheet and a recording head surface. Japanese Patent Laid-Open No. 2003-39758 describes a technology that prevents rising of a recording sheet and contact between the recording sheet and a recording head surface by attracting the recording sheet toward a platen by using an air suction mechanism. However, it is difficult to mount the air suction mechanism in an inkjet recording apparatus because the air suction mechanism would increase the size and the cost of the inkjet recording apparatus, which is usually small and inexpensive.

Japanese Patent No. 2994392 describes a recording apparatus in which a contact point between a conveying roller and a pinch roller, which are disposed upstream of a recording head, is located above a surface of the platen, and the pinch roller is disposed so as to be offset toward the platen from the top of the conveying roller. Thus, the recording sheet is conveyed in a direction such that the recording sheet is pressed against the platen, whereby rising of the recording sheet above the platen is suppressed and smudging of ink on a surface of the recording sheet due to contact between the recording sheet and the recording head surface is prevented. Because a specific component for preventing rising of the sheet is not used, this structure is suitable for an inkjet recording apparatus in terms of size and cost.

In the recording apparatus described in Japanese Patent No. 2994392, at the moment when the trailing end of a recording sheet P passes a contact point between the conveying roller and the pinch roller (hereinafter referred to as a conveying roller nip), the trailing end of the recording sheet P is placed on the conveying roller in the vicinity of the top of the conveying roller, which is higher than the platen.

In order to reduce printing time, a carriage motor is usually decelerated right after discharging of ink has been finished, so that a carriage 17 (see FIGS. 3A to 3C), which supports a recording head and which is scanning a recording sheet P, is temporarily stopped, and then scanning in the opposite direction is immediately started. Therefore, even when printing is performed up to a side edge of the recording sheet P in the width direction, the carriage 17 is stopped at a position at which a part of the carriage 17 faces the side edge of the recording sheet. If printing is finished at a position that is separated from the side edge of the recording sheet P by a certain distance, the recording head surface may be stopped above the recording sheet P. In general, a recording head protector, which is a member independent from or integrated with the carriage 17, is disposed on the carriage 17 so as to have a height the same as that of the recording head surface. The recording sheet P rises above the upper surface of the platen 14 as illustrated in FIG. 3B at the moment when the trailing end of the recording sheet P passes the conveying roller nip in a state in which the recording head surface and the recording head protector are stopped above the recording sheet P. As a result, the recording sheet P contacts the recording head surface and the recording head protector. Because ink mist adheres to the recording head surface and the recording head protector, ink smudges are transferred to the surface of the recording sheet P that contacts these members. This phenomenon more frequently occurs when the outer diameter of a conveying roller 8 is large, the length of the ink discharge nozzle array is large, and the distance between the conveying roller nip and an upstream eject roller 22 is large. Therefore, the surface of the recording sheet P contacts the recording head surface and a part of the carriage surrounding the recording head surface, and ink smudges adhere to the recording sheet P.

SUMMARY OF THE INVENTION

The present invention provides an inkjet recording apparatus that prevents a recording sheet from rising and contacting a recording head surface at the moment when the trailing end of the recording sheet passes a conveying roller nip and thereby prevents ink smudges from adhering to the recording sheet.

According to a first aspect of the invention, an inkjet recording apparatus includes an upstream conveying unit that includes a conveying roller and a pinch roller that is in contact with the conveying roller at a position that is displaced downstream of the conveying roller in a conveying direction of a sheet; a recording head disposed downstream of the upstream conveying unit, the recording head having a liquid discharge port surface on which discharge ports for discharging liquid therefrom are arranged; a carriage that supports the recording head and scans in a direction that intersects the conveying direction; a platen that supports the sheet at a position at which the platen faces the recording head; a downstream conveying unit that is disposed downstream of the carriage and that conveys the sheet; and a control unit that moves the carriage so that the liquid discharge port surface of the recording head is positioned outside a side edge of the sheet when a trailing end of the sheet passes a nip between the conveying roller and the pinch roller.

According to a second aspect of the invention, an inkjet recording apparatus, which performs recording by using a recording head having a liquid discharge port surface on which discharge ports for discharging liquid therefrom are arranged, includes an upstream conveying unit that is disposed upstream of the recording head and that includes a conveying roller and a pinch roller; a carriage that supports the recording head and scans in a direction that intersects a conveying direction of a sheet; a platen that is disposed below a nip between the conveying roller and the pinch roller and that supports the sheet at a position at which the platen faces the recording head; a downstream conveying unit that is disposed downstream of the carriage and that conveys the sheet; and a controller that moves the carriage so that scanning by the carriage to perform recording with the recording head and conveying of the sheet by the upstream conveying unit and the downstream conveying unit are alternately performed. When the carriage scans to perform recording immediately after a trailing end of the sheet has passed the nip between the conveying roller and the pinch roller, the control unit shifts a used region of the liquid discharge ports downstream in the conveying direction from a region used when the carriage scans to perform recording immediately before the trailing end of the sheet passes the nip. The control unit makes a conveying amount by which the sheet is conveyed between a scan by the carriage performed immediately before the trailing end of the sheet passes the nip and a scan by the carriage performed immediately after the trailing end of the sheet has passed the nip be larger than a conveying amount immediately therebefore. When the trailing end of the sheet passes the nip between the conveying roller and the pinch roller, the control unit moves the carriage so that the liquid discharge port surface of the recording head is positioned outside a side edge of the sheet.

With the aspects of the invention, adhering of ink smudges to a surface of a recording sheet when the trailing end of the recording sheet passes the conveying roller nip is prevented.

Further features of the present invention will become apparent from the following description of exemplary embodiments with reference to the attached drawings.

DESCRIPTION OF THE EMBODIMENTS

First Embodiment

A recording apparatus according to a first embodiment of the present invention will be described. The inkjet recording apparatus according to the first embodiment of the present invention can be used not only as a printer for a personal computer, but also as a copier and a multifunction printer having a facsimile function and other functions.

Figure 1:
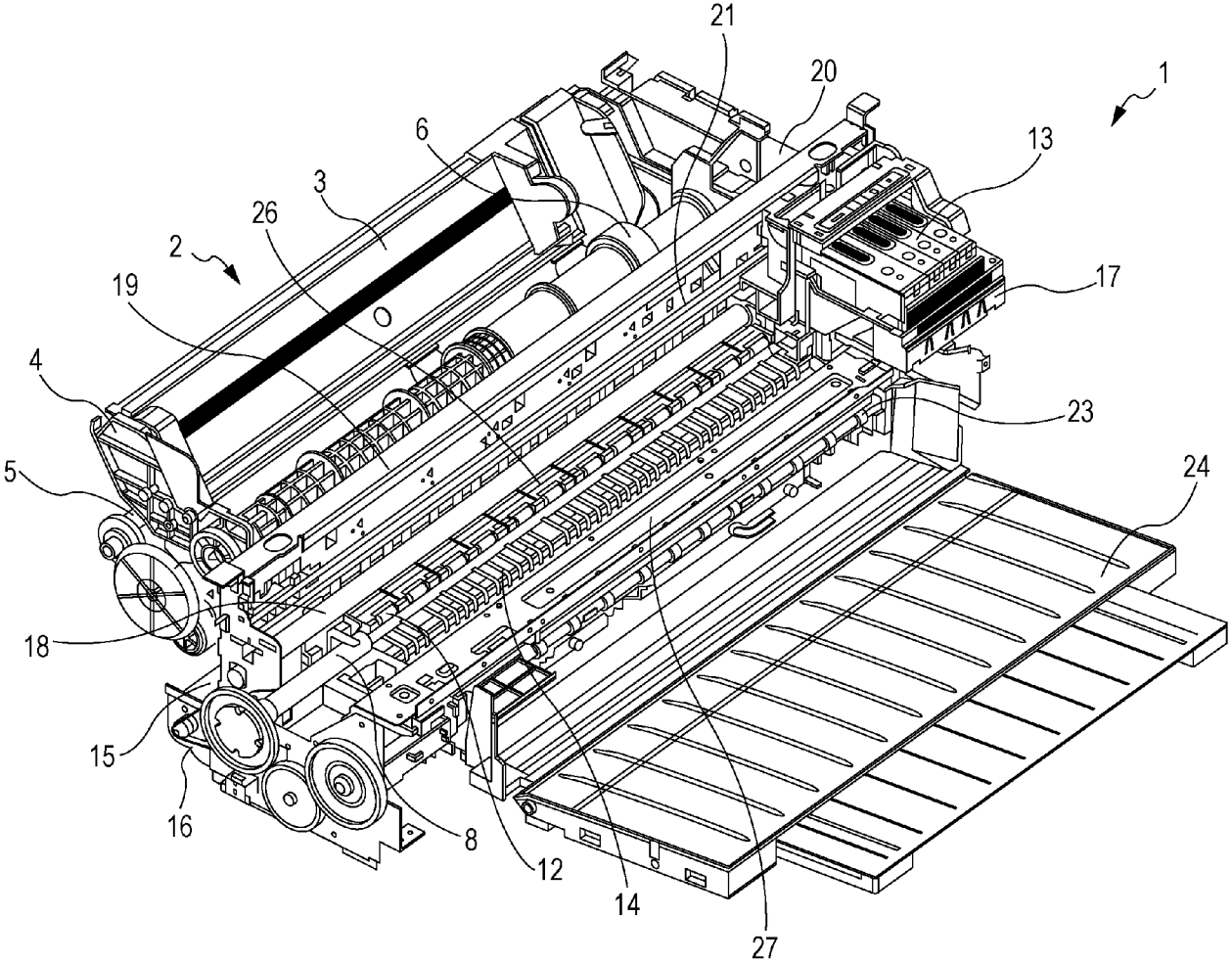
FIG. 1 is a perspective view of an inkjet recording apparatus according to a first embodiment of the present invention.
Figure 2:
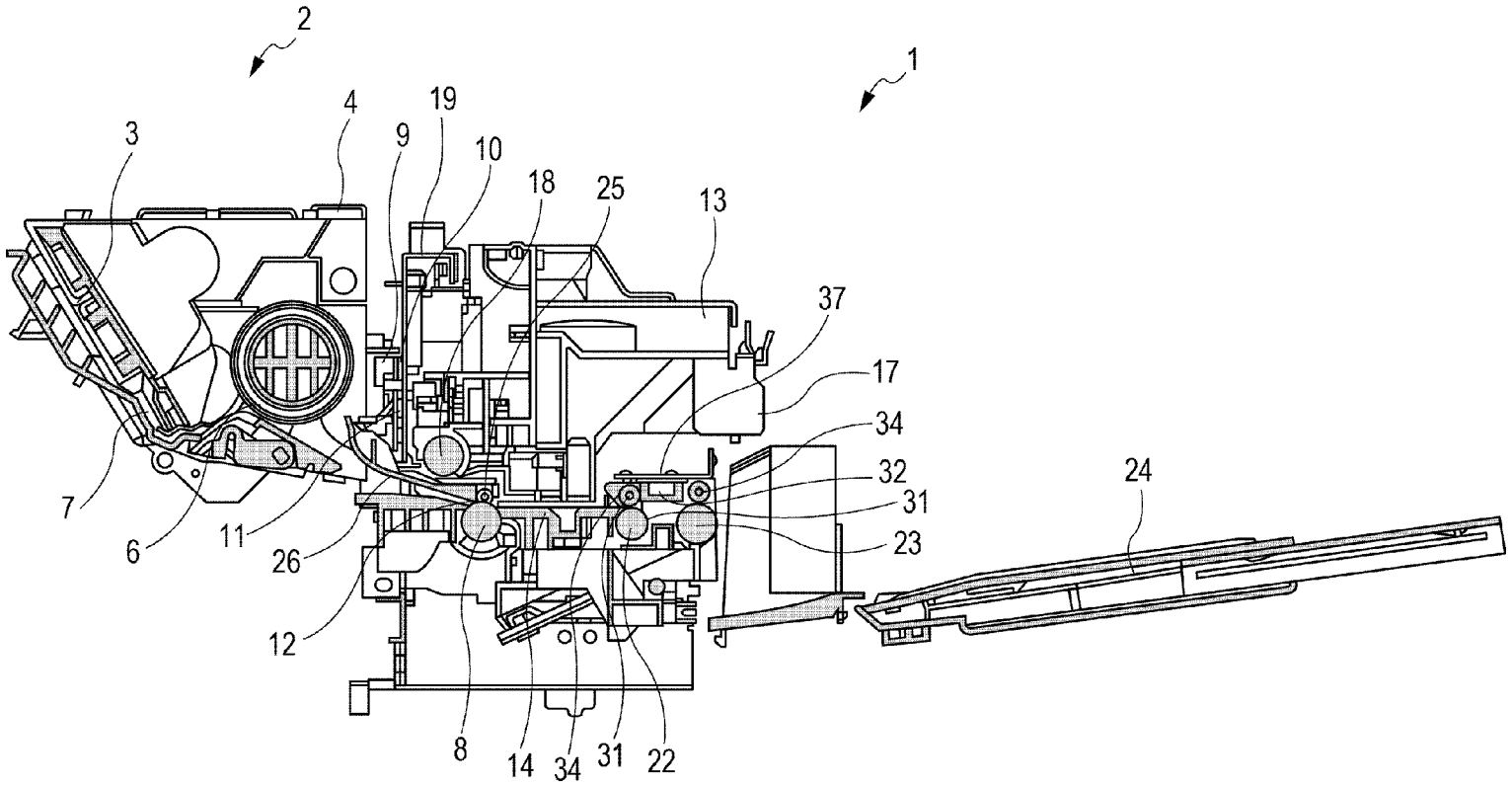
FIG. 2 is a cross-sectional view of the inkjet recording apparatus.

First, the overall structure of the apparatus will be described. FIG. 1 is a perspective view of an inkjet recording apparatus 1 according to the first embodiment of the present invention. FIG. 2 is a cross-sectional view of the inkjet recording apparatus 1. A pressure plate 3 of a sheet feeder 2 is rotatably supported by a sheet feeder frame 4. A stack of recording sheets is placed on the upper surface of the pressure plate 3. When feeding the recording sheet, a sheet feed motor 5, which is a drive source, rotates a feed roller 6, the pressure plate 3 is rotated toward the feed roller 6 by a pressure-plate spring 7, and the stack of recording sheets is pressed against the feed roller 6. As the feed roller 6 rotates, the uppermost one of the recording sheets is separated from the stack of recording sheets and fed downstream. As the feed roller 6 rotates further, the recording sheet separated and fed by the sheet feeder 2 is fed to a conveying roller 8, which corresponds to an upstream conveying unit. The leading end of the recording sheet separated and fed by the sheet feeder 2 pushes and rotates a sensor lever 9 disposed between the feed roller 6 and the conveying roller 8. Then, the sensor lever 9 is extracted from a sheet sensor 10, and thereby the leading end of the recording sheet is detected. The trailing end of the recording sheet is detected when the sensor lever 9 enters the sheet sensor 10.

A pinch roller 12 is urged against the conveying roller 8 by a pinch roller spring 11 through a pinch roller shaft 25 and a pinch roller holder 26. The pinch roller 12 is in contact with the conveying roller 8 at a position that is downstream of the top (highest point) of the conveying roller 8. Because the pinch roller 12 is in contact with the conveying roller 8 at a position that is displaced downstream in the conveying direction of the conveying roller 8, the recording sheet is pressed against a platen 14 while being conveyed.

After the leading end of the recording sheet is detected by the sheet sensor 10, the feed roller 6 conveys the recording sheet by a predetermined amount, and the leading end of the recording sheet is pressed against a conveying roller nip that is formed by contact between the conveying roller 8 and the pinch roller 12. As the recording sheet is further conveyed by the feed roller 6, a portion of the recording sheet near the leading end becomes warped, the leading end of recording sheet is pressed against the conveying roller nip, and an oblique-conveyance correcting operation is finished.

Figure 3A:
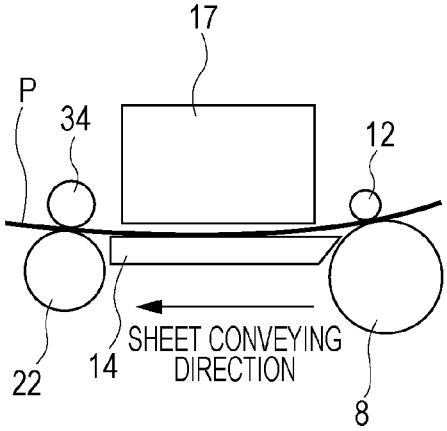
FIGS. 3A to 3C are schematic cross-sectional views of the inkjet recording apparatus.
Figure 3B:
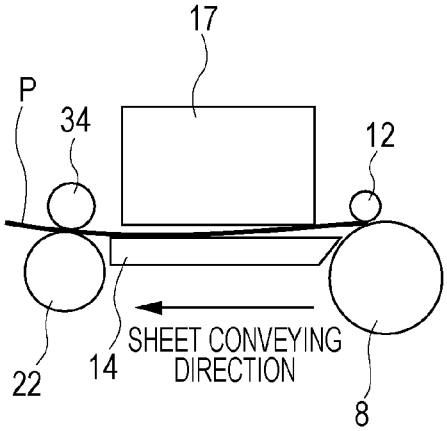
Figure 3C:
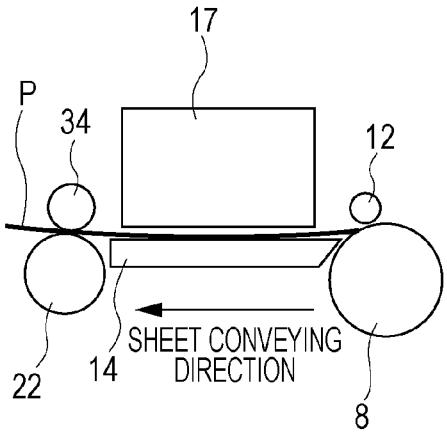

As illustrated in FIGS. 3A to 3C, the conveying roller nip is above the upper surface of the platen 14 by a predetermined distance, and the center of the pinch roller 12 is offset downstream from a vertical line that passes through the rotation center of the conveying roller 8. That is, the common tangent of the conveying roller 8 and the pinch roller 12 at the nip intersects the upper surface of the platen 14. Due to such a structure, the recording sheet that is pinched in the nip is pressed against the upper surface of the platen 14, so that the distance between the recording sheet and a recording head surface 28 (liquid discharge port surface) (FIG. 5) of a recording head 13 is kept constant. An upstream eject roller 22 and a downstream eject roller 23, which correspond to a downstream conveying unit, are disposed downstream of the recording head 13 in the conveying direction.

After the oblique-conveyance correcting operation is finished, the recording sheet is conveyed by the conveying roller 8 onto the platen 14, and is held on the upper surface of the platen 14 at a position at which the recording sheet faces the recording head surface 28 of the recording head 13. The conveying roller 8 is rotated by a conveying motor 15, which is a drive source, through a conveying roller timing belt 16.

Next, a carriage 17 scans the recording sheet, which is held on the upper surface of the platen 14, in a direction that intersects the conveying direction of the recording sheet while the recording head 13, which is attached to the carriage 17, discharges ink droplets to the recording sheet, whereby printing is performed. The carriage 17 is supported by a guide shaft 18 and a guide rail 19 so that the carriage 17 can scan the recording sheet in a direction perpendicular to the conveying direction of the recording sheet. The carriage 17 is driven by a carriage motor 20 through a carriage timing belt 21. Scanning by the carriage 17 to perform recording with the recording head 13 and conveying of the recording sheet by the conveying roller 8, the upstream eject roller 22, and the downstream eject roller 23 are performed alternately. Recording on the recording sheet is performed by using all discharge ports in a region N of an ink discharge nozzle array 27. When performing multipass (n-pass) recording, every time the recording head performs one scan, the recording sheet is conveyed by a distance N/n.

On the downstream side of the recording head 13, the recording sheet is conveyed while being nipped between the downstream eject roller 23 and a spur roller 34 and between the upstream eject roller 22 and another spur roller 34. The spur rollers 34 are rotatably supported by a spur roller holder 32 through spur roller springs 31 that are bar-shaped coil springs. The spur roller springs 31 urge the spur rollers 34 against the downstream eject roller 23 and the upstream eject roller 22. A drive force is transmitted from the conveying roller 8 to the downstream eject roller 23 and the upstream eject roller 22 through a gear train and the like. A reinforcement plate 37, which is made of a metal, is disposed so as to suppress warping of the spur roller holder 32, which is made thin to reduce the size of the inkjet recording apparatus 1.

The recording head 13 includes fine liquid discharge ports (orifices), a liquid channel, an energy acting portion formed in a part of the liquid channel, and an energy generator. The energy generator generates liquid-droplet forming energy that acts on the liquid in the energy acting portion. An inkjet recording method uses an electromechanical transducer, such as a piezoelectric element, as the energy generator for generating such energy. Another inkjet recording method uses an energy generator that heats a liquid by irradiating the liquid with an electromagnetic wave, such as laser light, and discharges liquid droplets due to the heat. Still another inkjet recording method uses an energy generator that heats a liquid by using an electrothermal conversion member, such as an exothermic element, and discharges the liquid.

Among these inkjet recording methods, high-resolution recording can be performed by using the method that discharges liquid by using thermal energy, because liquid discharge ports (orifices) can be arranged with a high density in a recording head. In particular, a recording head using an electrothermal conversion member as the energy generator can be easily reduced in size. A recording head using the electrothermal conversion member can take full advantage of recently-developed semiconductor technology, highly-reliable IC technology, and micromachining technology. Moreover, such a recording head is suitable for high density mounting, and the manufacturing cost is low.

As printing progresses, the trailing end of the recording sheet passes the sensor lever 9 and approaches the conveying roller nip. When the trailing end of the recording sheet passes the conveying roller nip, the recording sheet may be pushed in the conveying direction due to an urging force of the pinch roller 12. When such a phenomenon occurs, the conveying roller 8, the upstream eject roller 22, and the downstream eject roller 23 rotate by an amount corresponding the backlash of the gear train that drives these rollers, whereby the recording sheet is conveyed by a conveying amount that is larger than an intended predetermined amount. Therefore, if conveying of the recording sheet is finished at the moment when the trailing end of the recording sheet passes the conveying roller nip, an error in the conveying amount generated due to the backlash of the gear train cannot be corrected and a large error occurs in the conveying accuracy. To address this problem, a control operation called a nozzle shift operation is performed.

Figure 4:
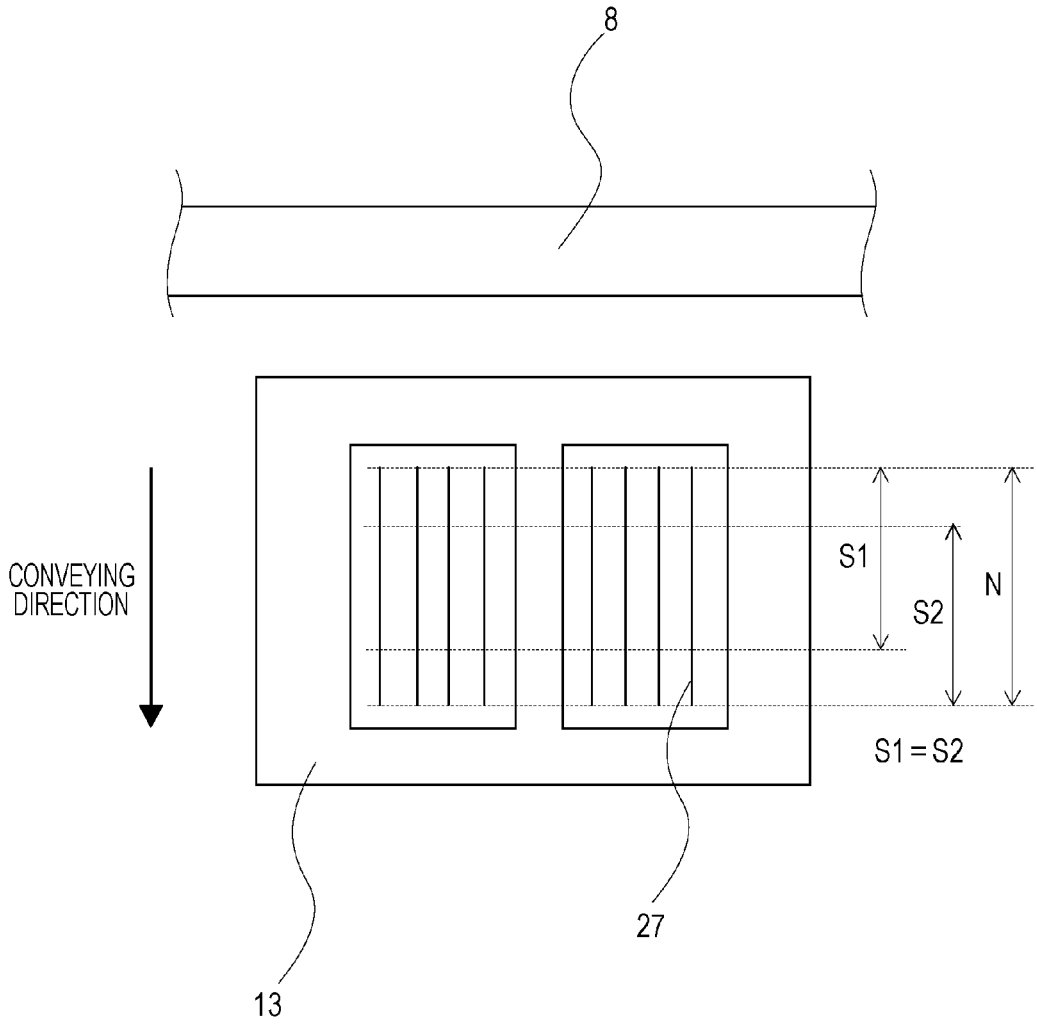
FIG. 4 is a schematic view of a recording head surface, illustrating a nozzle shift of the inkjet recording apparatus.
Figure 5:
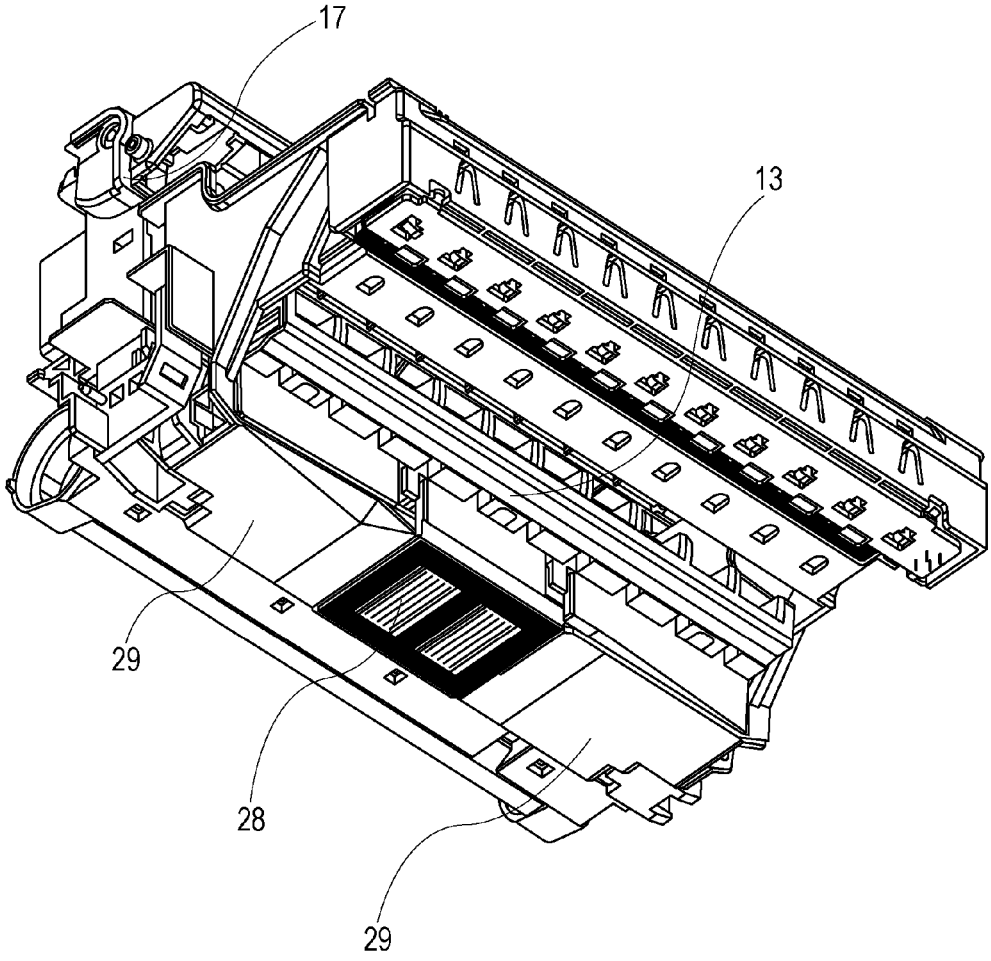
FIG. 5 is a bottom perspective view of a carriage of the inkjet recording apparatus on which a recording head is mounted.
Figure 6:
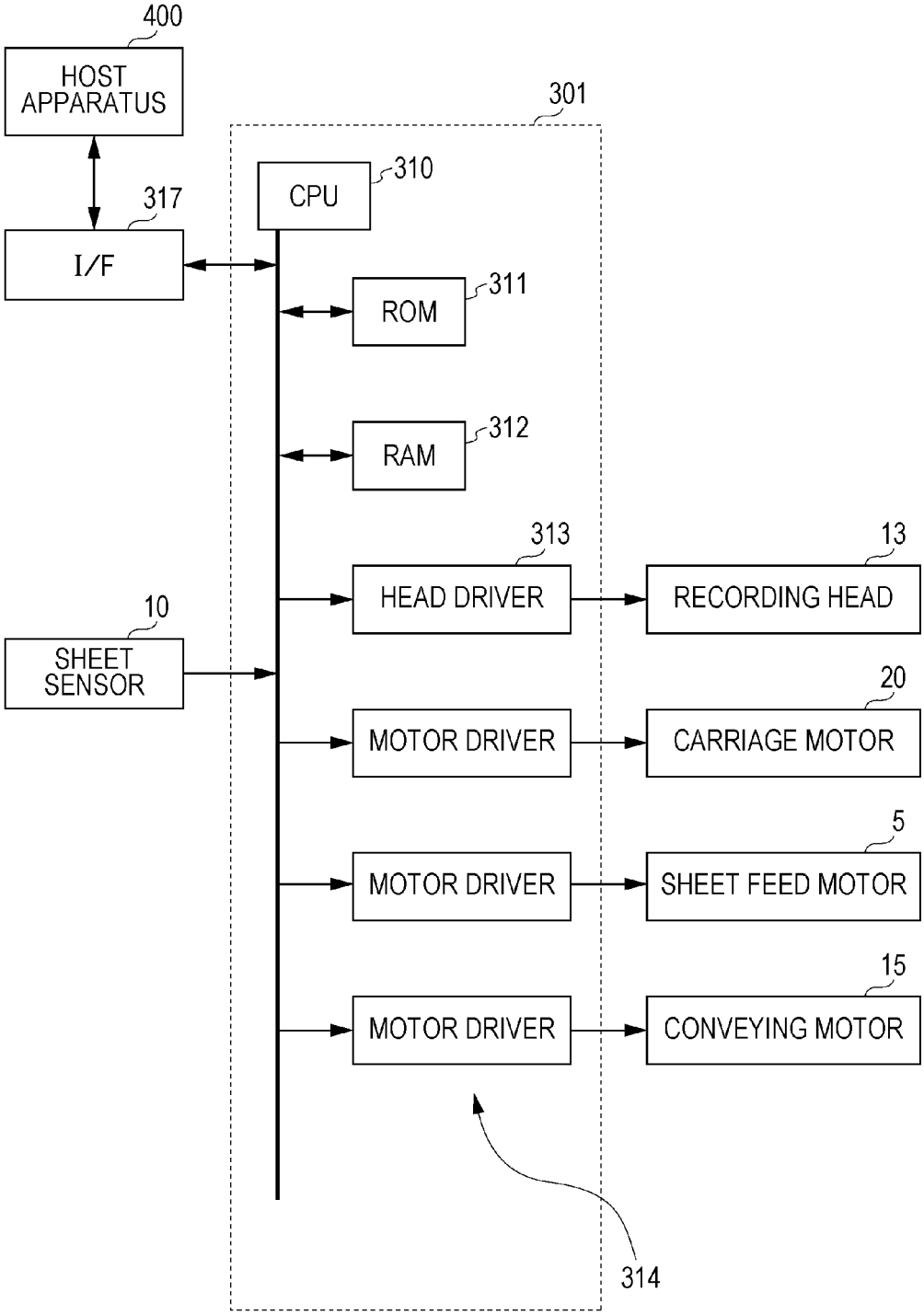
FIG. 6 is a control block diagram of the inkjet recording apparatus.
Figure 7:
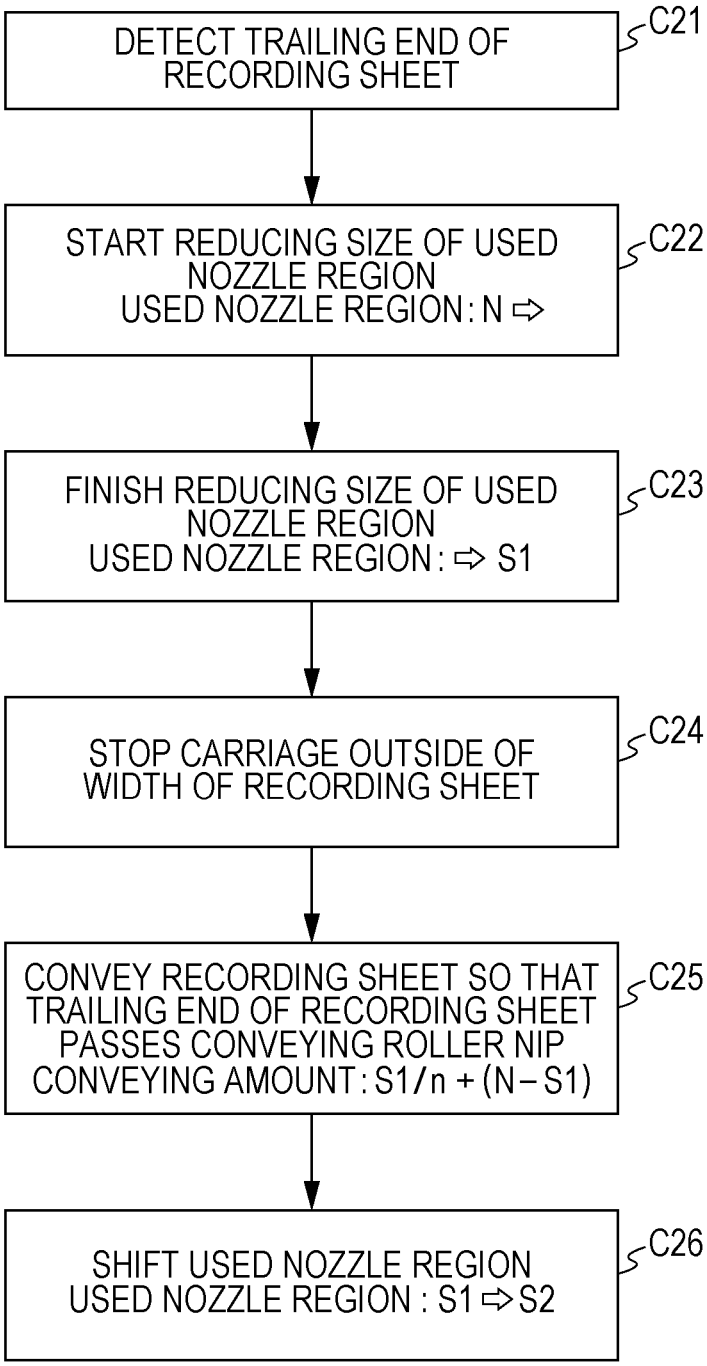
FIG. 7 is a flowchart of a nozzle shift operation of the inkjet recording apparatus.

FIGS. 3A to 3C illustrate rising of a recording sheet P when the trailing end of the recording sheet P is at different positions. FIG. 4 is a top see-through view of the recording head 13. The ink discharge nozzle array 27 has a plurality of ink discharge nozzles. FIG. 5 is a bottom perspective view of the carriage 17 on which the recording head 13 is mounted. The ink discharge nozzle array 27 is formed on the recording head surface 28 (liquid discharge port surface). Recording head protectors 29 are disposed on the carriage 17 such that the height thereof is substantially the same as that of the recording head surface 28. FIG. 6 is a control block diagram of the inkjet recording apparatus. FIG. 7 is a flowchart of the nozzle shift operation.

Referring to FIG. 6, a control circuit board 301, which corresponds to a control unit, includes a CPU 310, a ROM 311, and a RAM 312. The CPU 310 controls the inkjet recording apparatus and issues various control commands. The ROM 311 stores control data and the like. The RAM 312 serves as an area in which recording data and the like are loaded. A head driver 313 drives the recording head 13. Motor drivers 314 respectively drive the carriage motor 20, the sheet feed motor 5, and the conveying motor 15. Data is sent to and received from a host apparatus 400, such as a computer and a digital camera, through an interface 317.

Figure 8:
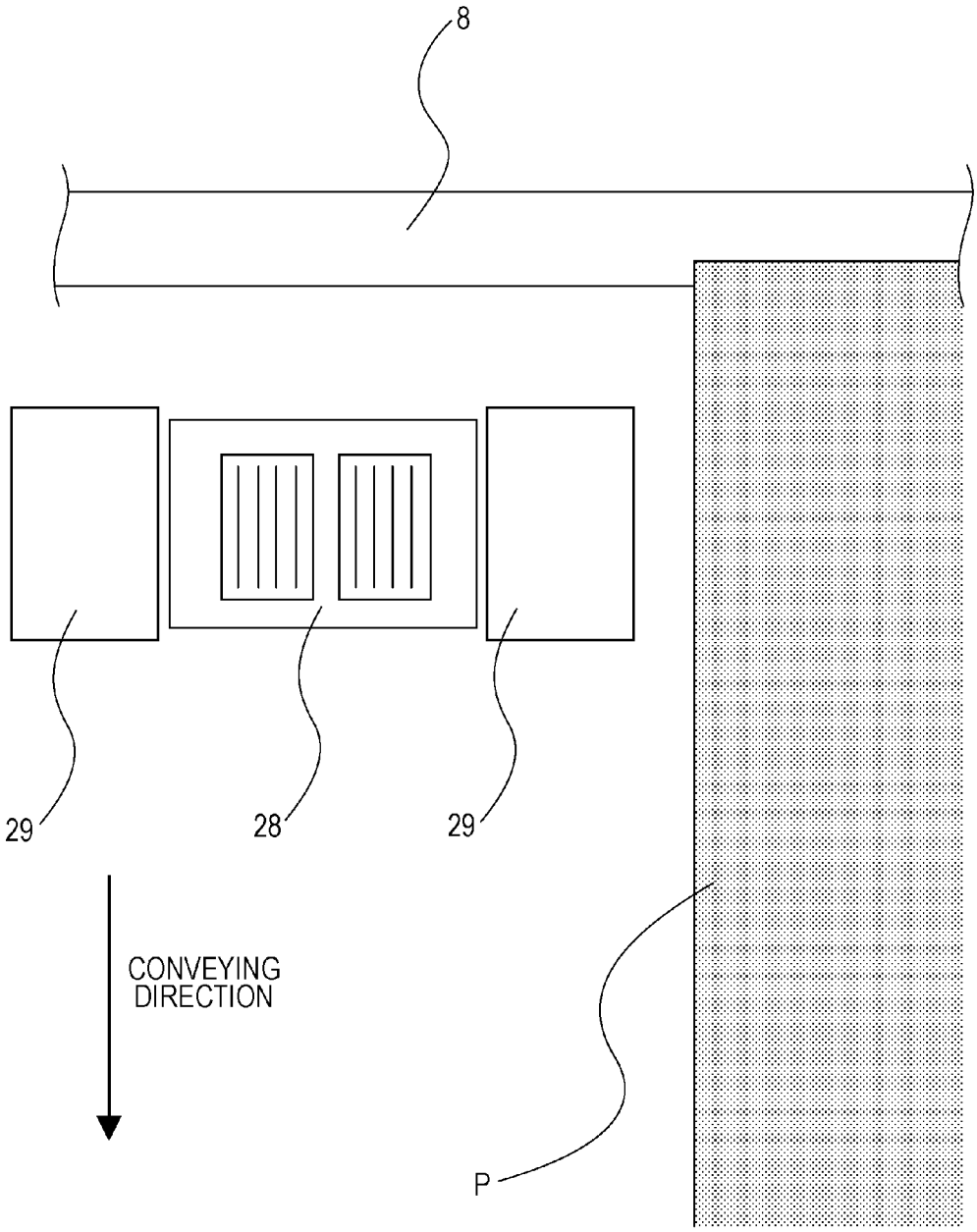
FIG. 8 is a schematic view illustrating the positional relationship between the recording head and a recording sheet when the inkjet recording apparatus performs a nozzle shift operation.

Next, the operation of the inkjet recording apparatus will be described. Before the trailing end of the recording sheet P passes the sensor lever 9 and is detected by the sheet sensor 10, multipass recording (n passes) is performed by using all discharge ports in the region N of the ink discharge nozzle array 27. At this time, as illustrated in FIG. 3A, the recording sheet P is pressed against the upper surface of the platen 14 due to the offset of the pinch roller 12, so that the recording sheet P does not rise above the upper surface of the platen 14. After the trailing end of the recording sheet P is detected by the sheet sensor 10 in step C21 of FIG. 7 and before the trailing end of the recording sheet P passes the conveying roller nip, the used region of discharge ports is reduced in size from the region N to a region S1 of the ink discharge nozzle array 27 (steps C22 and C23). Because n-pass recording is performed by using ink discharge nozzles in the region S1, the conveying amount for one pass is (length of region S1)/n. After scanning by the carriage 17 to perform recording immediately before the recording sheet P is conveyed and the trailing end of the recording sheet P passes the conveying roller nip has been finished, the carriage 17 is moved to and stopped at the position illustrated in FIG. 8 irrespective of the position at which discharging of ink was finished. When the carriage 17 is stopped at the position illustrated in FIG. 8, the recording head surface 28 of the recording head and the recording head protectors 29, which have lower surfaces at substantially the same height as the recording head surface 28, are located outside a side edge of the recording sheet P (step C24). Next, in a state in which the carriage 17 is stopped at this position, the recording sheet P is conveyed by a conveying amount that is larger than the last conveying amount (length of region S1)/n in order to sufficiently correct an error caused by excessive conveying by a conveying amount corresponding to a backlash of the gear train. To be specific, the recording sheet P is conveyed by a conveying amount that is the sum of (length of region S1)/n, which is the conveying amount for n-pass recording using the discharge ports in the region S1, and ((length of region N)−(length of region S1)), which is the conveying amount for the nozzle shift operation (step C25).

Because the carriage 17 is moved to a position outside the side edge of the recording sheet P, the recording head surface 28 and the recording head protectors 29, which are smudged with ink mist, are not present above the recording sheet P. Therefore, the recording head surface 28 and the recording head protectors 29 do not contact the surface of the recording sheet P, even if the vicinity of the trailing end of the recording sheet P rises above the upper surface of the platen 14 at the moment when the trailing end of the recording sheet P passes the conveying roller nip as illustrated in FIG. 3B. Therefore, ink mist that adheres to the recording head surface 28 and the recording head protectors 29 is not transferred to the surface of the recording sheet P. Thus, the carriage is moved to a position outside the side edge of the sheet when the sheet is conveyed and the trailing end of the sheet passes the nip, so that the sheet does not contact the recording head surface 28.

When the trailing end of the recording sheet P passes the conveying roller nip and conveying of the recording sheet P is finished, the trailing end of the recording sheet P is located at a position that is separated from the top of the conveying roller 8 in the conveying direction of the recording sheet as illustrated in FIG. 3C. Therefore, the vicinity of the trailing end of the recording sheet P does not rise above the upper surface of the platen 14 to a large extent, so that it is unlikely that the recording head surface 28 and the recording head protectors 29 contact the surface of the recording sheet P during the next scan performed by the carriage 17.

Increase in printing time can be limited to the minimum by moving the recording head surface 28 and the recording head protectors 29 to positions outside the side edge of the recording sheet P only immediately before the trailing end of the recording sheet passes the conveying roller nip.

Next, because the sheet is conveyed by a conveying amount that is the sum of (length of region S1)/n and (length of region N)−(length of region S1), if recording is performed by using the discharge ports in the region S1, an image is not formed at a position that is continuous with the image that has been recorded immediately before that time. In order to form a continuous image, the region of the ink discharge nozzle array 27 used for scan that is performed immediately after the trailing end of the sheet passes the nip is shifted downstream by (length of region N)−(length of region S1) from the region S1 to a region S2 (step C26).

After printing has been finished, the recording sheet is output to a sheet output tray 24 by the downstream eject roller 23, the upstream eject roller 22, and the spur roller 34.

With the structure described above, a recording apparatus that can prevent a recording sheet from being smudged when the trailing end of the recording sheet passes a conveying roller nip can be provided without increasing the manufacturing cost and the size of the apparatus.

Second Embodiment

Figure 9:
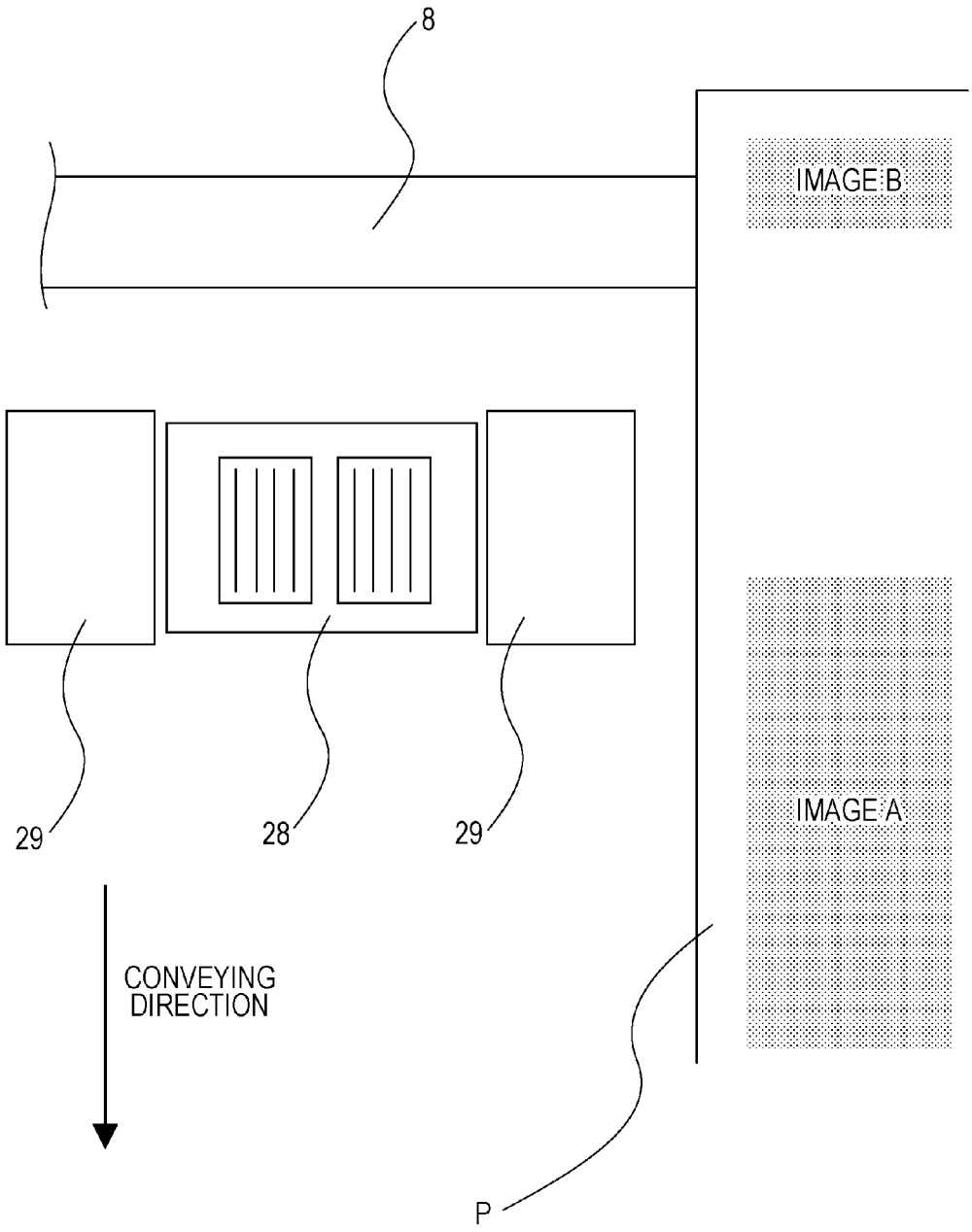
FIG. 9 is a schematic view illustrating images printed on a recording sheet by an inkjet recording apparatus according to a second embodiment of the present invention.

In the case where images A and B illustrated in FIG. 9 are printed on the recording sheet P when printing is finished, printing of the image A on the recording sheet P is finished before the trailing end of the recording sheet P passes the conveying roller nip. Subsequently, instead of being conveyed for a nozzle shift operation, the sheet is conveyed by a large amount so as to skip a blank part of the sheet P and printing is restarted to form the image B before the trailing end of the sheet P passes the conveying roller nip. In this case, after the image A has been printed, the carriage 17 is stopped at a position such that the recording head surface 28 and the recording head protectors 29, the surfaces of which are at substantially the same height as the recording head surface 28, are located outside the side edge of the recording sheet P irrespective of the position at which discharging of ink is finished.

Thus, while the recording sheet P is conveyed by a large conveying amount from the position at which the image A has been printed to the position at which printing of the image B is started, the recording head surface 28 and the recording head protectors 29 that are smudged with ink mist are not present above the recording sheet P. Even if the trailing end of the recording sheet P passes the conveying roller nip and rises during the interval, ink that adheres to the recording head surface 28 or the recording head protectors 29 is not transferred to the surface of the recording sheet P.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-191202 filed Aug. 27, 2010, which is hereby incorporated by reference herein in its entirety.

What is claimed is:

1. An inkjet recording apparatus comprising:

an upstream conveying unit that includes a conveying roller and a pinch roller that is in contact with the conveying roller at a position that is displaced downstream of the conveying roller in a conveying direction of a sheet;

a recording head disposed downstream of the upstream conveying unit, the recording head having a liquid discharge port surface on which discharge ports for discharging liquid therefrom are arranged;

a carriage that supports the recording head and scans in a direction that intersects the conveying direction;

a platen that supports the sheet at a position at which the platen faces the recording head;

a downstream conveying unit that is disposed downstream of the carriage and that conveys the sheet; and a control unit that moves the carriage so that the liquid discharge port surface of the recording head is positioned outside a side edge of the sheet when a trailing end of the sheet passes a nip between the conveying roller and the pinch roller.

2. The inkjet recording apparatus according to claim 1, wherein the control unit moves the carriage so that a liquid discharge port surface of the recording head and a portion of the carriage that is substantially at the same height as the liquid discharge port surface of the recording head are positioned outside the side edge of the sheet when the sheet is conveyed and the trailing end of the sheet passes the upstream conveying unit.

3. The inkjet recording apparatus according to claim 1, wherein the platen is disposed below the nip between the conveying roller and the pinch roller.

4. The inkjet recording apparatus according to claim 1, wherein, when the carriage scans to perform recording immediately after the trailing end of the sheet has passed the nip between the conveying roller and the pinch roller, the control unit shifts a used region of the liquid discharge ports in the conveying direction from a region used when the carriage scans to perform recording immediately before the trailing end of the sheet passes the nip, and wherein the control unit makes a conveying amount by which the sheet is conveyed between a scan by the carriage performed immediately before the trailing end of the sheet passes the nip and a scan by the carriage performed immediately after the trailing end of the sheet has passed the nip be larger than a conveying amount immediately therebefore.

5. An inkjet recording apparatus that performs recording by using a recording head having a liquid discharge port surface on which discharge ports for discharging liquid therefrom are arranged, the inkjet recording apparatus comprising:

an upstream conveying unit that is disposed upstream of the recording head and that includes a conveying roller and a pinch roller;

a carriage that supports the recording head and scans in a direction that intersects a conveying direction of a sheet;

a platen that supports the sheet at a position at which the platen faces the recording head, the position being located below a nip between the conveying roller and the pinch roller;

a downstream conveying unit that is disposed downstream of the carriage and that conveys the sheet; and a controller that moves the carriage so that scanning by the carriage to perform recording with the recording head and conveying of the sheet by the upstream conveying unit and the downstream conveying unit are alternately performed, wherein, when the carriage scans to perform recording immediately after a trailing end of the sheet has passed the nip between the conveying roller and the pinch roller, the control unit shifts a used region of the liquid discharge ports downstream in the conveying direction from a region used when the carriage scans to perform recording immediately before the trailing end of the sheet passes the nip, and wherein the control unit makes a conveying amount by which the sheet is conveyed between a scan by the carriage performed immediately before the trailing end of the sheet passes the nip and a scan by the carriage performed immediately after the trailing end of the sheet has passed the nip be larger than a conveying amount immediately therebefore, and wherein, when the trailing end of the sheet passes the nip between the conveying roller and the pinch roller, the control unit moves the carriage so that the liquid discharge port surface of the recording head is positioned outside a side edge of the sheet.

6. The inkjet recording apparatus according to claim 5, wherein the control unit moves the carriage so that a liquid discharge port surface of the recording head and a portion of the carriage that is substantially at the same height as the liquid discharge port surface of the recording head are positioned outside the side edge of the sheet when the sheet is conveyed and the trailing end of the sheet passes the upstream conveying unit.

7. An inkjet recording apparatus comprising:

an upstream sheet conveying unit that includes a conveying roller and a pinch roller that is in contact with the conveying roller at a position that is displaced downstream of the conveying roller in a conveying direction of a sheet;

a recording head disposed downstream of the upstream conveying unit, the recording head having a liquid discharge port surface on which discharge ports for discharging liquid therefrom are arranged;

a carriage that supports the recording head and reciprocatingly scans in a direction that intersects the conveying direction of the sheet;

a platen that supports a non-recording surface of the sheet at a position at which the platen faces the recording head, the position being located below a nip between the conveying roller and the pinch roller;

a downstream conveying unit that is disposed downstream of the recording head, the downstream conveying unit including an eject roller and a spur roller, conveying the sheet, and ejecting the sheet on which an image has been recorded to the outside of the inkjet recording apparatus; and a control unit that moves the carriage, in a case where an image forming operation is temporarily finished before a trailing end of the sheet passes the nip between the conveying roller and the pinch roller and the image forming operation is restarted after the sheet is conveyed further and the trailing end of the sheet has passed the nip between the conveying roller and the pinch roller, so that the liquid discharge port surface of the recording head is positioned outside a side edge of the sheet while the sheet is being conveyed until the trailing end of the sheet passes the nip between the conveying roller and the pinch roller.

8. A recording apparatus comprising:

a carriage having a recording head, configured to reciprocate with respect to a sheet in a direction;

a pair of rollers, configured to nip and convey the sheet at upstream of the recording head; and a controller configured to perform serial printing by repeating step movement of the sheet by the rollers and recording by the recording head while moving the carriage, wherein, while performing a predetermined step movement when a trailing end of the sheet passes a nip between the rollers, the carriage waits at a first position outside of the sheet in the direction, the first position is outside of a second position in the direction where the carriage waits while performing step movements before the predetermined step movement.

9. The recording apparatus according to claim 8, wherein a liquid discharge surface of the recording head and a bottom portion of the carriage is positioned outside of the sheet in the direction when the carriage waits at the first position.

10. The recording apparatus according to claim 8, further comprising a platen configured to support the sheet at a position at which the platen faces the recording head, wherein the platen is disposed below a nip of the pair of rollers.

11. The recording apparatus according claim to 10, wherein an upper roller of the pair of rollers is in contact with a lower roller of the pair of rollers at a position that is downstream of the highest point of the lower roller of the pair of rollers.

12. The recording apparatus according to claim 8, wherein a distance of the predetermined step movement is longer than a distance of step movements before the predetermined step movement.

13. The recording apparatus according to claim 12, wherein when the carriage scans to perform recording immediately after the predetermined step movement, the controller performs the serial printing by changing liquid discharge ports for discharging ink of the recording head to be used, from a first group of liquid discharge ports included in a first region to a second group of liquid discharge ports included in a second region which is shifted in a conveying direction of the pair of rollers from the first region, after the predetermined step movement.

14. An inkjet recording apparatus comprising:

a convey roller configured to convey a sheet;

a pinch roller configured to pinch the sheet with the convey roller;

a recording head disposed downstream of the convey roller, the recording head having a liquid discharge port surface on which discharge ports for discharge liquid are arranged;

a carriage that supports the recording head and moves the recording head; and protectors configured to protect the liquid discharge port surface, wherein the liquid discharge port surface is disposed between the protectors and the protectors move integrally with the carriage, and wherein the carriage moves to perform recording within an area in which at least a part of one of the protectors faces to the sheet, and the carriage moves such that when a trailing end of the sheet passes a nip between the convey roller and the pinch roller, the liquid discharge port surface and the protectors are located outside a side edge of the sheet.

15. The inkjet recording apparatus according to claim 14, further comprising a platen configured to support the sheet at a position at which the platen faces the recording head, wherein the platen is disposed below the nip.

16. The inkjet recording apparatus according to claim 15, wherein the pinch roller is in contact with the convey roller at a position that is downstream of the highest point of the convey roller.

17. The inkjet recording apparatus according to claim 14, wherein a distance of a predetermined conveyance in which the trailing end of the sheet passes the nip is longer than a distance of a conveyance before the predetermined conveyance.

18. The inkjet recording apparatus according to claim 17, wherein when the carriage scans to perform recording immediately after the predetermined conveyance, a used region of liquid discharge ports of the recording head in a conveying direction of the convey roller is shifted from a region of the liquid discharge ports used when the carriage scans to perform recording before the predetermined conveyance.

19. The inkjet recording apparatus according to claim 14, wherein when the carriage moves to perform recording within the area in which the protectors faces to the sheet, if recording is finished at a position that is separate from the side edge of the sheet, a movement of the carriage toward the side edge of the sheet is finished at a position that is separate from the side edge of the sheet.

20. The inkjet recording apparatus according to claim 19, wherein the carriage moves such that when the trailing end of the sheet passes the nip between the convey roller and the pinch roller, the liquid discharge port surface and the protectors are located outside the side edge of the sheet irrespective of a position at which recording is finished immediately before the sheet passes the nip.

21. The inkjet recording apparatus according to claim 14, wherein the protectors are independent from the carriage.

22. The inkjet recording apparatus according to claim 14, wherein the protectors are integrated with the carriage.

* * * * *